United States Patent [19]

Meng et al.

[11] 4,046,923

[45] Sept. 6, 1977

[54] PACKAGE WITH STAGGERED PRODUCT SLICES AND PROCESS FOR PRODUCING THE SAME

[75] Inventors: John C. Meng; Gerald J. Driessen, both of Green Bay, Wis.

[73] Assignee: L. D. Schreiber Cheese Co., Inc., Green Bay, Wis.

[21] Appl. No.: 81,687

[22] Filed: Oct. 19, 1970

[51] Int. Cl.[2] ..... A23C 19/16

[52] U.S. Cl. ..... 426/130; 53/26; 206/449; 206/499; 206/526; 426/121; 426/129; 426/414

[58] Field of Search ..... 99/178; 426/130, 121, 426/129, 414

[56] References Cited

U.S. PATENT DOCUMENTS

| | | | |
|---|---|---|---|
| 2,907,109 | 10/1959 | Palmer | 99/178 |
| 3,092,501 | 6/1963 | Beck et al. | 99/178 X |

*Primary Examiner*—Tim R. Miles

[57] ABSTRACT

A package is disclosed herein that includes a plurality of individual product slices positioned in face abutting engagement with one another, with the lateral edges of adjacent slices being offset relative to one another, and with the lateral edges of alternating slices being positioned in alignment with one another. All of the edges are parallel with one another, and the stack of staggered slices is enclosed within a wrapping material.

The package is produced by interleaving a first group of product ribbons within a second group of product ribbons, with the lateral edges of all of the ribbons parallel, and with the lateral edges of the first group of ribbons being offset with respect to the lateral edges of the second group of ribbons. The stack of offset ribbons is severed in longitudinally spaced locations to segregate the stack of ribbons into individual stacks of staggered product slices, which are subsequently wrapped to provide individual packages.

The apparatus for producing the offset packages include a pair of parallel adjacent support members each having a plurality of guide members thereon that bear against opposite edges of the product ribbons, with the gaps between adjacent pairs of guide members being offset to arrange the ribbons into a stack wherein adjacent ribbons are offset relative to one another and alternating ribbons are aligned with one another.

10 Claims, 5 Drawing Figures

Inventors.
Gerald J. Driessen
John C. Meng
By
Dressler, Goldsmith, Clement & Gordon
Attys

PACKAGE WITH STAGGERED PRODUCT SLICES AND PROCESS FOR PRODUCING THE SAME

BACKGROUND OF THE INVENTION

In the past it is well known to package a plurality of substantially identically shaped product slices within an enclosure. In handling certain items, such as comestibles like cheese and meat, difficulty has been encountered in separating one slice from another. This problem is particularly acute in fast service restaurants, where sandwiches are produced at a rapid rate making ease of separability of a product, such as cheese, extremely desirable.

SUMMARY OF THE INVENTION

The present invention provides a unique arrangement for facilitating the separation of product slices from the remaining slices in a package. Each slice in applicants' package includes an offset edge that provides a manually grippable handle that facilitates the separation of an individual slice from the remaining slices of the product stack. In applicants' package, a stack of rectangular product slices is provided, with the lateral edges of adjacent slices being offset relative to one another. The lateral edges of alternating slices are aligned with one another, and the edges of the slices are parallel and perpendicular to the top and bottom of the package so that a cubic stack results that can be positioned in self-supporting relationship upon a horizontal surface, and which can be easily enclosed within an overwrap by conventional presently available equipment.

The process of producing applicants' package includes the steps of dividing a sheet of product into a plurality of individual ribbons of the same lateral dimension, and arranging the ribbons into first and second groups, with the first group of ribbons having their edges in alignment, and with the second group of ribbons having their edges in alignment and offset from the edges of the first group of ribbons. The ribbons of the first group are interleaved with the ribbons of the second group, to provide a stack of ribbons wherein adjacent ribbons have offset lateral edges and alternating ribbons have aligned lateral edges. The stack of ribbons is then severed at longitudinally spaced areas to divide the ribbons into individual stacks of offset product slices, and the individual stacks are enclosed within a wrapping material.

The apparatus for producing the offset ribbons includes first and second spaced, parallel support members each having a plurality or ribbon guide members thereon. Each guide member on one support member is aligned with a guide member on the other support member, so that a plurality of pairs of guide members are provided. The guide members are positioned to bear against the side edges of a product ribbon, and the gap between one pair of guide members is offset relative to an adjacent pair of members, so that adjacent ribbons are guided into offset relation with respect to one another. The gaps between alternating guide members are aligned, so that the alternating ribbons in the ribbon stack have their edges in alignment with one another.

DESCRIPTION OF THE PREFERRED EMBODIMENT

Figure 1:
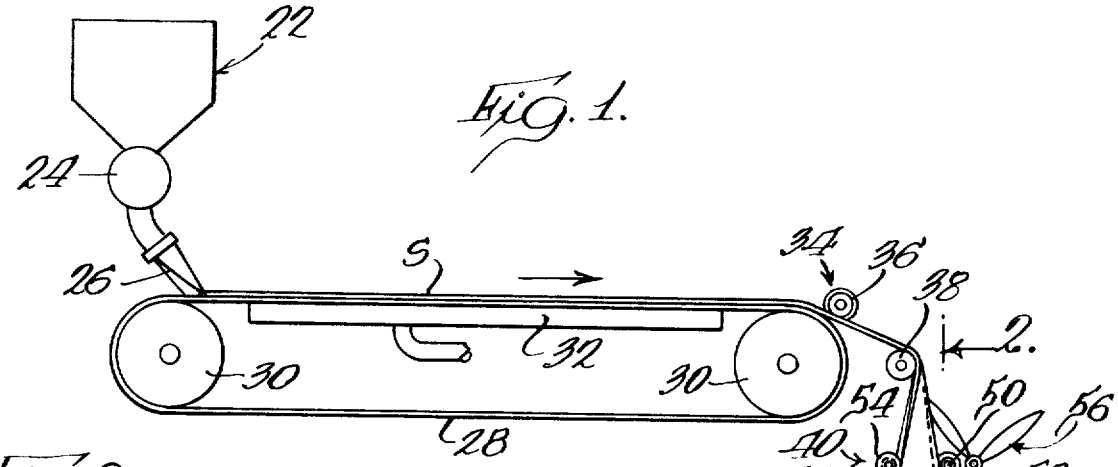
FIG. 1 is a side elevational view illustrating schematically apparatus for producing the package of the present invention.

While this invention is susceptible of embodiment in many different forms, there is shown in the drawings and will herein be described in detail a preferred embodiment of the invention, with the understanding that the present disclosure is to be considered as an exemplification of the principles of the invention and is not intended to limit the invention to the embodiment illustrated. The scope of the invention will be pointed out in the appended claims.

Figure 5:
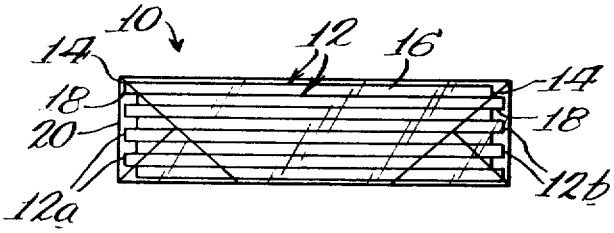
FIG. 5 is an end view of an embodiment of the package of the present invention.

Referring first to FIG. 5, an embodiment of the package of the present invention is illustrated in its entirety at 10, and the package 10 includes a plurality of thin, flat, individual slices 12 that are positioned in face abutting engagement with one another. Each slice 12 is rectangular, and all of the slices are of substantially uniform size and thickness. The slices include parallel side edges 14, and parallel end edges 16 disposed perpendicularly with respect to side edges 14. The stack of slices 12 within package 10 includes a first group of slices **12*a* that is offset to one side, and a second group of slices 12*b* that is offset to the opposite side. The side edges 14 of slices 12*a* are positioned in vertical alignment with one another, while the side edges 14 of slices 12*b* are positioned in vertical alignment with one another and in parallel offset relationship with respect to the side edges of the slices 12*a***.

With this arrangement, a series of offset manually grippable handles or lifting portions 18 are provided at opposite sides of the package 10 and the handles 18 project outwardly from an adjacent underlying slice a sufficient amount to enable the uppermost slice 12 to be readily separated from the remaining slices. Because the exposed edges of slices **12*a* and slices 12*b* are in alignment, the exposed edges cooperate to provide a surface so that the package 10 can be supported on its sides as well as on the top or the bottom. The entire stack of slices is enclosed within a wrapper 20**, which preferably takes the form of a transparent plastic film.

In order to maximize the ease of separability of the slices, it is desirable that the handles 18 extend outwardly as far as possible from the edge of the adjacent slice. However, particularly with a flexible and plastic product such as cheese, if the offset is too large, sagging of the offset portions occur which not only negates the purpose of having the offset, but also which produces an unsightly package. Applicants have found that with pasteurized process sharp American type of cheese of 7/64 inch thickness, the maximum amount the slices can be offset without sagging is about 5/16 inch. In order to provide a sufficient handle, the offset must be more than about ⅛ inch for cheese of the above mentioned type and thickness, and thus the offset should be in the range of from ⅛ inch to 5/16 inch. Packages wherein the slices are offset by 3/16 inch and ¼ inch have provided a handle of sufficient length to facilitate slice separation with no sagging at the unsupported edge of the slice.

The method and apparatus for forming package 10 will be best understood from FIGS. 1–4, and as illustrated in FIG. 1, a source of molten product, such as cheese, is provided at 22, and a pumping means 24 communicates with source 22 for forcing the fluent product through a laterally elongate nozzle means 26 onto the upper reach of an endless belt 28. Belt 28 is trained over a pair of drums 30, one of which may be driven. Belt 28 is preferably formed of a suitable metallic material, such as stainless steel, to facilitate cooling and solidification of the product and to permit ready separation of the solidified product from the belt. The product sheet S laid down by nozzle 26 is solidified as it passes over a coolant bath 32 that is positioned below the upper reach of belt 28. The cooled product then passes to a cutting station 34 where a cutting member having a plurality of laterally spaced cutting elements 34 severs the sheet S into a plurality of ribbons R1–R8 (FIG. 2) of equal width. The ribbons then move over a guide roll 38 and pass to an offsetting station 40.

Figure 2:
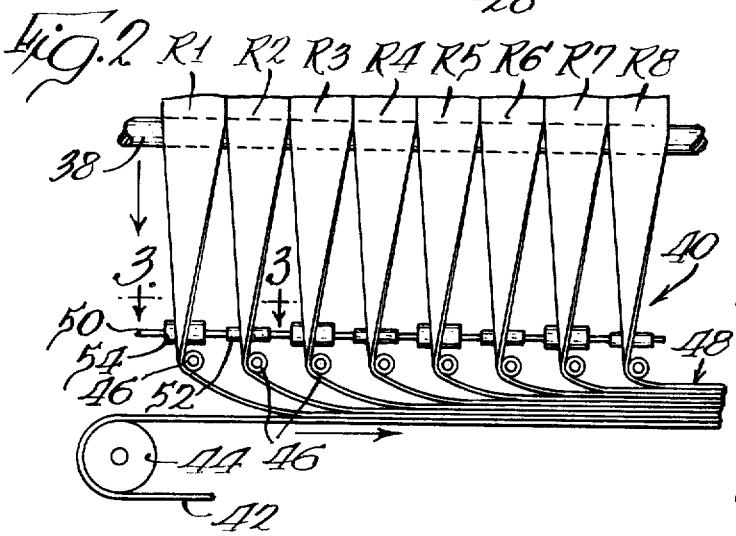
FIG. 2 is an enlarged view taken generally along line 2—2 of FIG. 1.
Figure 3:
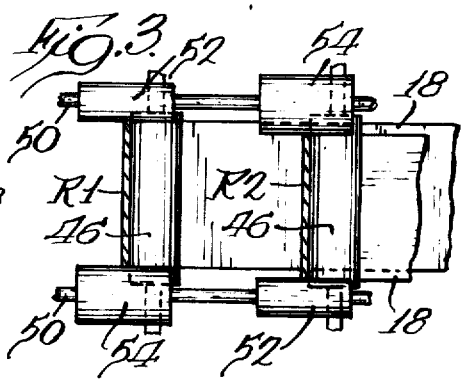
FIG. 3 is a still further enlarged view taken generally along line 3—3 of FIG. 2.
Figure 4:
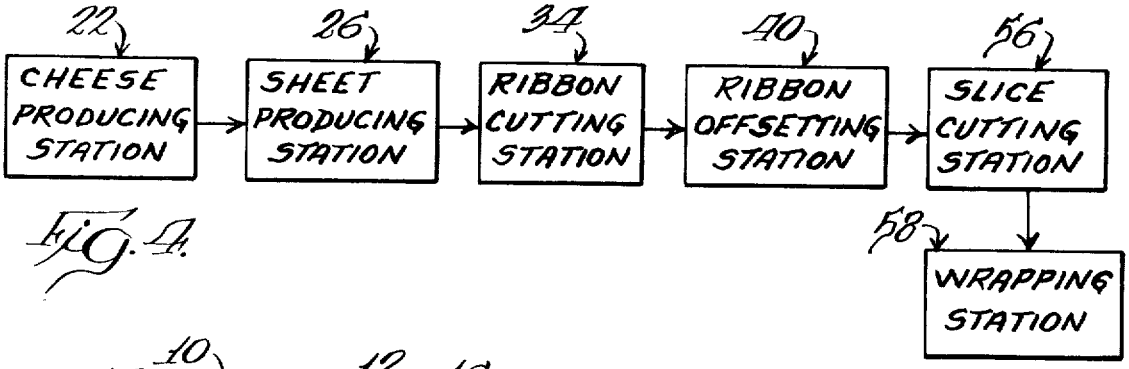
FIG. 4 is a flow diagram illustrating the various steps of the process of the present invention.

The remaining steps of the process of the present invention are carried out on, or adjacent to, a further conveyor defined by an endless belt 42 that is trained over spaced drums 44, one of which is shown in FIG. 2. As is evident from FIG. 1, belt 42 is positioned at right angles with respect to belt 28, and is located vertically therebelow. As is evident from FIG. 2, a plurality of horizontally disposed rollers 46 are positioned in alignment with one another above the upper reach of belt 42, and product ribbons R1–R8 pass over rollers 46 to twist the ribbons 90° and guide them into a stack 48. However, before the stack 48 is formed, the ribbons are offset at the offsetting station 40.

The means for offsetting the ribbons includes a pair of spaced parallel support members 50 having a plurality of pairs of ribbon guide members 52, 54 thereon, each pair corresponding to one of ribbons R1–R8. As is evident from FIGS. 1 and 2, guide members 52 and 54 bear against the edge of the ribbon associated therewith, and the guide members 52 and 54 are preferably in the form of plastic rollers that are rotatably mounted on support members 50. Rollers 52 are all of the same diameter, as are rollers 54, although it is evident from FIG. 3 that rollers54 are substantially larger in diameter than rollers 52. The rollers 52 and 54 on each support member 50 are concentrically arranged, so that each pair of rollers 52, 54 defines a gap of equal width corresponding to the width of ribbons R1–R8. From the foregoing description, it is evident that the pairs of rollers 52, 54 serve to provide offsets 18 in the adjacent ribbons in the ribbon stack 48.

After the ribbons have been stacked in offset relationship, belt 42 transports the same to a slice cutting station, where a cutting element 56 severs the ribbon stack 48 to segregate the stack into a plurality of individual stacks of staggered slices. The stacks of staggered slices are then transported to a wrapping station 58, where the stacks may be weighed, labeled and wrapped with a transparent film 20, in accordance with the teachings of commonly assigned copending application of Bush et al. Ser. No. 9,578 filed Feb. 9, 1970 and now U.S. Pat. No. 3,650,773 granted Mar. 21, 1972. The present invention is not to be construed as being limited to any specific type of wrapping system, and the system of the above mentioned Bush et al. patent is expressly referred to herein only for purposes of example.

What is claimed is:

1. A package comprising: a plurality of quadrilateral product slices formed of a flexible, plastic material, such as cheese, each slice having substantially the same external dimensions, said slices being arranged in a stack with a major portion of adjacent slices in face abutting engagement with one another, the lateral edges of adjacent slices being parallel and offset relative to one another to provide a gripping portion that extends laterally outwardly relative to an adjacent slice, said gripping portions having a dimension that is sufficient to facilitate manual separation of the slices but insufficient to allow the gripping portions to sag out of the plane of the major portion of the slice, the lateral edges of the offset portions of alternating slices being aligned with one another to provide parallel surfaces at opposite sides of the stack that are perpendicular to the top and bottom thereof, and wrapping means enclosing said stack therewithin.

2. A package as set forth in claim 1, wherein the offset is less than 5/16 inch.

3. A package as set forth in claim 1, wherein the offset is greater than ⅛ inch.

4. A package as set forth in claim 1, wherein the offset is between ⅛ inch and 5/16 inch.

5. A package as set forth in claim 1, wherein only a single stack of product slices is enclosed within said wrapper means.

6. A process of producing a package having staggered product slices comprising: providing a first group of product ribbons formed of a flexible, plastic material, such as cheese, said ribbons each having substantially the same lateral dimension; maintaining the lateral edges of the ribbons of said first group in alignment with one another; providing a second group of product ribbons formed of a flexible, plastic material, such as cheese, said ribbons each having substantially the same lateral dimensions as the first group of product ribbons; maintaining the lateral edges of the ribbons of said second group in alignment with one another; arranging said first and second groups into a stack in which a ribbon of each group is adjacent a ribbon of the other group with the lateral edges of all the ribbons being parallel and with the lateral edges of the first group being offset from the lateral edges of the second group, the dimension of said offset being sufficiently small to prevent the offset edges from sagging; said edge maintaining and group arranging steps being performed by moving the ribbons of each group past guide members and locating the guide members such that a guide member bears against at least one lateral edge of each ribbon; severing said stack of ribbons in longitudinally spaced locations to segregate the stack of ribbons into individual stacks of staggered product slices; and applying a wrapper to each individual stack of staggered product slices.

7. In an improved process for stacking and packaging uniform slices of food wherein the food is produced in substantially continuous plural ribbons vertically descending from a congealing roll, the improvement comprising: twisting each vertical ribbon to arrange all surfaces thereof parallel and in opposed face-to-face alignment; aligning one set of outside edges of alternate ribbons; aligning the opposite set of outside edges of the intervening ribbons so as to be offset a small distance sufficient to present at least one grippable edge per slice and to preserve the interdigitating identity of those edges when overwrapped with respect to corresponding edges of said alternate ribbons; turning each ribbon horizontally in parallel courses so as to form a group of said ribbons stacked in surface-abutting relation having the outer edges thereof alternately overlapped in opposite directions; cutting said grouped ribbons at equal intervals to produce groups of slices; and wrapping said groups of slices.

8. A process for producing a package having staggered product slices comprising: providing a plurality of product ribbons formed of a flexible, plastic material such as cheese, said ribbons having substantially the same lateral dimensions, offsetting adjacent ribbons laterally relative to one another while maintaining alternating ribbons in alignment with one another, guiding the ribbons into overlapping relationship to provide a stack of ribbons, wherein the lateral edges of adjacent ribbons are offset relative to one another, the dimension of said offset being sufficiently small to prevent the offset edges from sagging; said ribbon offsetting and guiding steps being performed by moving the ribbons of each group past guide members, and locating the guide members such that a guide member bears against at least one lateral edge of each ribbon; severing said stack of ribbons in longitudinally spaced locations to segregate the stack of ribbons into individual stacks of staggered product slices, and thereafter applying a wrapper to said stacks of product slices.

9. A process as set forth in claim 8 wherein said ribbon offsetting and guiding steps are performed by moving each ribbon past a guide roller that bears against one lateral edge of the ribbon.

10. A process as set forth in claim 8 wherein said ribbon offsetting and guiding steps are performed by moving each ribbon between a pair of laterally spaced guide rollers that engage opposite lateral edges of the ribbon.

* * * * *